US007032574B2

(12) United States Patent
Sturman

(10) Patent No.: US 7,032,574 B2
(45) Date of Patent: Apr. 25, 2006

(54) MULTI-STAGE INTENSIFIERS ADAPTED FOR PRESSURIZED FLUID INJECTORS

(75) Inventor: Oded E. Sturman, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 73 days.

(21) Appl. No.: 10/782,486

(22) Filed: Feb. 19, 2004

(65) Prior Publication Data

US 2004/0188537 A1 Sep. 30, 2004

Related U.S. Application Data

(60) Provisional application No. 60/457,018, filed on Mar. 24, 2003.

(51) Int. Cl.
*F02M 37/04* (2006.01)

(52) U.S. Cl. ..... 123/446; 123/496

(58) Field of Classification Search ..... 123/446
See application file for complete search history.

(56) References Cited

U.S. PATENT DOCUMENTS

| | | | | |
|---|---|---|---|---|
| 4,006,859 | A * | 2/1977 | Thoma | 239/89 |
| 4,173,208 | A | 11/1979 | Fenne et al. | |
| 4,627,571 | A * | 12/1986 | Kato et al. | 239/90 |
| 4,856,713 | A | 8/1989 | Burnett | |
| 5,440,968 | A * | 8/1995 | Sekine | 92/6 R |
| 5,460,329 | A | 10/1995 | Sturman | |
| 5,826,562 | A * | 10/1998 | Chen et al. | 123/446 |
| 5,906,351 | A * | 5/1999 | Aardema et al. | 251/30.01 |
| 6,085,991 | A | 7/2000 | Sturman | |
| 6,119,960 | A * | 9/2000 | Graves | 239/92 |
| 6,257,499 | B1 | 7/2001 | Sturman | |
| 6,474,304 | B1 | 11/2002 | Lei | |
| 6,776,138 | B1 | 8/2004 | Mahr et al. | |
| 6,830,202 | B1 | 12/2004 | Coldren | |
| 6,868,831 | B1 * | 3/2005 | Lei | 123/467 |
| 2002/0053340 | A1 * | 5/2002 | Lei | 123/446 |
| 2003/0155437 | A1 * | 8/2003 | Lei | 239/533.2 |
| 2003/0178508 | A1 | 9/2003 | Coldren | |
| 2005/0092306 | A1 * | 5/2005 | Shinogle et al. | 123/531 |

* cited by examiner

*Primary Examiner*—Thomas Moulis
(74) *Attorney, Agent, or Firm*—Blakely, Sokoloff, Taylor & Zafman LLP

(57) ABSTRACT

Multi-stage intensifiers for injectors of pressurized fluid (e.g., fuel) allowing selection of intensified injection fluid pressure and thus fluid injection flow rate by selectively applying actuating fluid supply pressure to one or more of the multi-stage intensifiers. In a disclosed embodiment, two coaxial unequal sized intensifier pistons are used, with a control valve controlling selective pressurization of either the relatively smaller intensifier piston, or pressurization of both the relatively smaller intensifier piston and the relatively larger intensifier piston to control the intensified injection fluid pressure and flow rate of injection. Other embodiments, including ones using multi-stage intensifiers mechanically coupled together, controlled by different types of control valves and having more than two stages are also disclosed.

10 Claims, 7 Drawing Sheets

MULTI-STAGE INTENSIFIERS ADAPTED FOR PRESSURIZED FLUID INJECTORS

CROSS-REFERENCE TO RELATED APPLICATION

This application claims the benefit of U.S. Provisional Patent Application No. 60/457,018 filed Mar. 24, 2003.

BACKGROUND OF THE INVENTION

1. Field of the Invention

The present invention relates generally to the field of pressurized fluid injectors and, for example, more particularly to intensified pressure fuel injectors.

2. Prior Art

Intensified fuel injectors are well known in the prior art. While not so limited, intensified fuel injectors are commonly used as fuel injectors on diesel-cycle internal combustion engines. Prior art patents on such fuel injectors include U.S. Pat. No. 5,460,329 issued to Oded E. Sturman on Oct. 24, 1995 and U.S. Pat. No. 6,257,499 B1 issued to Oded E. Sturman on Jul. 10, 2001. Such fuel injectors have some form of valve and valve control system for controllably providing an actuating fluid, typically fuel or engine oil, to a relatively large piston that mechanically drives a relatively smaller piston to actually pressurize the fuel to a desired higher level for injection purposes. Typically the fluid driving the larger piston is provided from a supply or common rail at a relatively low pressure, with the pressure of the fuel being injected at a higher pressure being a function of the rail pressure and the ratio of the two effective piston areas. The ratio of the areas may be, by way of example, on the order of 9 to 1 so that the pressure of the fuel being injected is much higher than the rail pressure.

If the rail pressure is constant, the rate of fuel injection will be substantially constant. Consequently, the only control over the amount of fuel injected in any single injection event would be the control of the length of time of the injection. This is far less than ideal, particularly under partial load conditions, as it tends to concentrate the injection over too small of a crankshaft angle, and in compression ignition engines, may require concentrating the injection closer to top dead center of the engine cycle than desired.

To help reduce this problem, it is known to vary the rail pressure with engine operating conditions to provide some control over the fuel injection rate, in addition to the control provided by control of the injection duration. However, wide, rapid, and repeatable variation in rail pressures is not an easy thing to accomplish and accordingly, the range of rail pressure variation typically is somewhat limited.

BRIEF SUMMARY OF THE INVENTION

Multi-stage intensifiers for injectors of pressurized injection fluid, such as fuel, allowing selection of intensifier injection fluid-pressure and thus fluid injection rate by selectively applying actuating fluid supply pressure to one or more of the multi-stage intensifiers are disclosed. In one disclosed embodiment, two coaxial unequal sized intensifier pistons are used, with a control valve controlling selective pressurization of either the relatively smaller intensifier piston, or pressurization of both the relatively smaller intensifier piston and the relatively larger intensifier piston to control the intensifier pressure and injection rate. Other embodiments, including ones using multi-stage intensifiers mechanically coupled together, controlled by different types of control valves and having more than two stages are disclosed. The invention may be used alone or in a system that also provides a capability of also varying the supply pressure of the actuating fluid used to power the intensifier, such as engine oil, fuel, hydraulic fluid, or some other fluid.

DETAILED DESCRIPTION OF THE PREFERRED EMBODIMENTS

The present invention comprises multi-stage intensifiers for pressurized fluid injectors. The multi-stage intensifiers have the advantage of providing control over the rate of injection of pressurized fluids, such as fuel, in lieu of or in addition to the control that may be provided by also varying the rail pressure, if desired. The multi-stage intensifiers also provide substantially immediate control, one injection event to another, and in fact could be used to vary the injection rate during a single injection event if such control is desired. For purposes of illustration and not for the purposes of limitation, exemplary two-stage control systems will be disclosed in detail herein.

Figure 1:
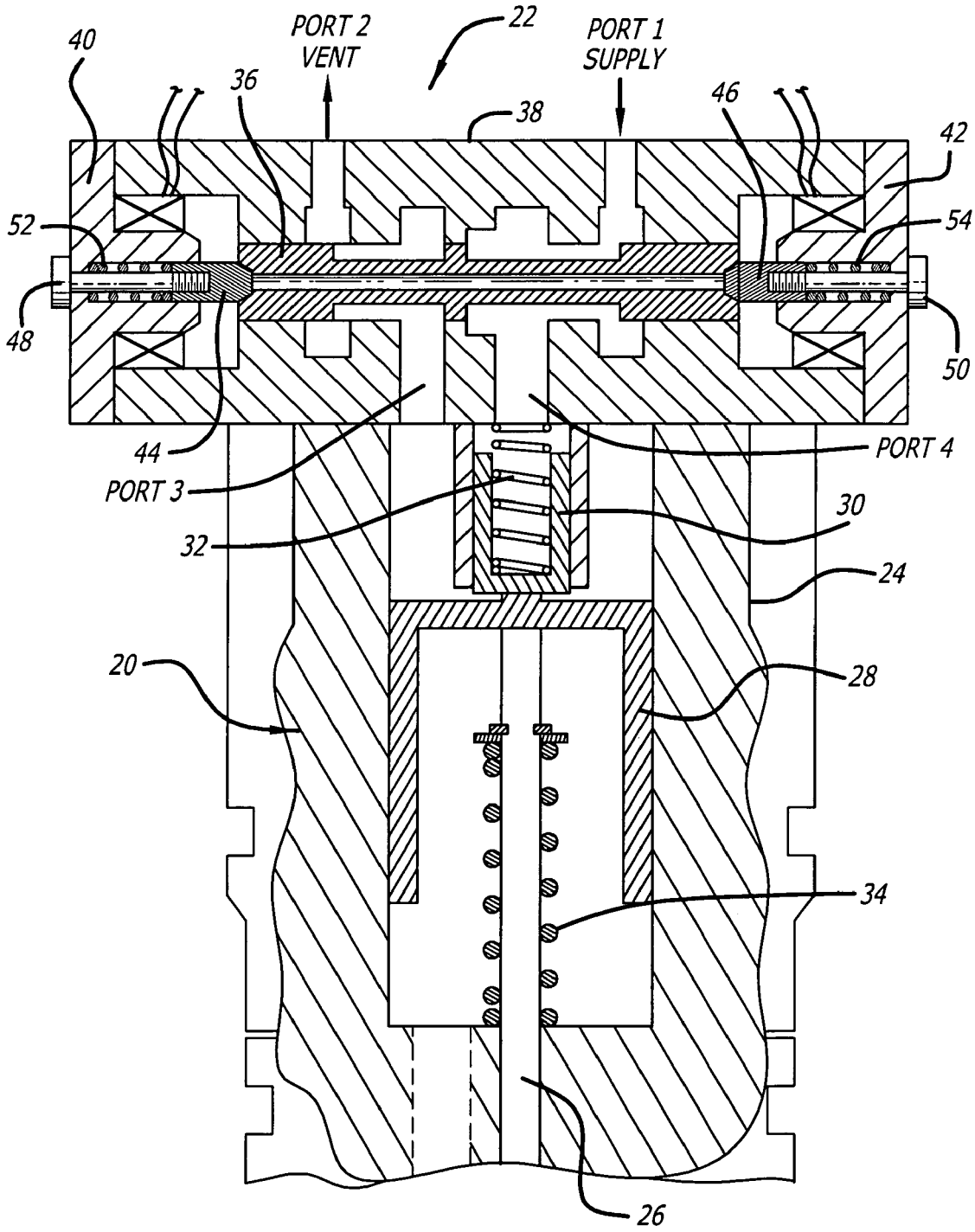
FIG. 1 is a schematic cross sectional view of the upper portion of a fluid injector and a control valve in accordance with one embodiment of the present invention.

Now referring to FIG. 1, a cross section of the upper portion of a fuel injector, generally indicated by the numeral 20, and a control valve, generally indicated by the numeral 22, may be seen. This cross section and the other cross sections to be described herein are for illustrative purposes only, as detailed designs for the injectors as well as the control valve, and even the type of control valve used, may vary widely in order to meet the requirements of a particular application.

As shown in FIG. 1, the injector 20 includes an injector body 24 which houses, among other things, a fluid injection pump piston 26, one or a first intensifier piston 28, and another or second intensifier piston 30. In the embodiment shown, the effective area of the intensifier piston 28 is relatively larger than the effective area of the intensifier piston 30. Also shown within the housing 20 is a mechanical coil spring 32 arranged to bias the relatively smaller intensifier piston 30 downward, and a relatively stronger (i.e., higher spring rate) return spring 34 arranged to bias the fluid injection pump piston 26 and thus the relatively larger piston 28 and relatively smaller piston 30 upward against the resistance of spring 32. The housing 24 is shown in FIG. 1 in schematic form only, as typically such housings are comprised of an assembly of two or more parts, frequently held together by mating screw threads, to allow machining, drilling, etc. as required for the required porting, etc. (see for instance, U.S. Pat. No. 6,257,499 B1).

Referring again to FIG. 1, the exemplary control valve 22 is a dual coil magnetically latchable actuator spool control valve having a neutral, intermediate or third position, as well as first and second positions. Valves of this general type are shown in U.S. Pat. No. 6,105,616 issued to Oded E. Sturman et al. on Aug. 22, 2000. The control valve 22 includes a movable spool 36 that slides in a spool valve housing 38 having end caps 40 and 42, the spool valve housing 38 and end caps 40,42 being formed from a magnetically attractable material such as by way of example, 4140 alloy steel. The spool itself, when in the neutral position, is maintained in the neutral position by spring loaded members 44 and 46 axially positioned by screw pins 48 and 50 biased to the position shown in FIG. 1 by mechanical coil springs 52 and 54.

The spool valve 22 in the exemplary embodiment functions as a four-way, three-position spool valve. In the position of the spool valve shown in FIG. 1, port 1 (the actuating fluid supply port) is in fluid communication with port 4 (a cylinder port) providing pressurized actuating fluid to the effective area of the relatively smaller piston 30. At the same time, the effective area over the relatively larger piston 28 is vented through port 3 (another cylinder port) to port 2 (a vent port) which may be at atmospheric pressure, though preferably is somewhat higher such as at a pressure of about 1 to 5 bar. When the spool valve 36 is in this position, the hydraulic force acting downward on the relatively smaller intensifier piston 30 is equal to the effective area $A_2$ of the relatively smaller intensifier piston 30 times the actuating fluid pressure. Assuming the fluid injection pump piston 26 has an effective area $A_1$, the fluid (e.g., fuel) then being injected will be at a pressure of $A_2/A_1$ times the actuating fluid pressure.

Figure 2:
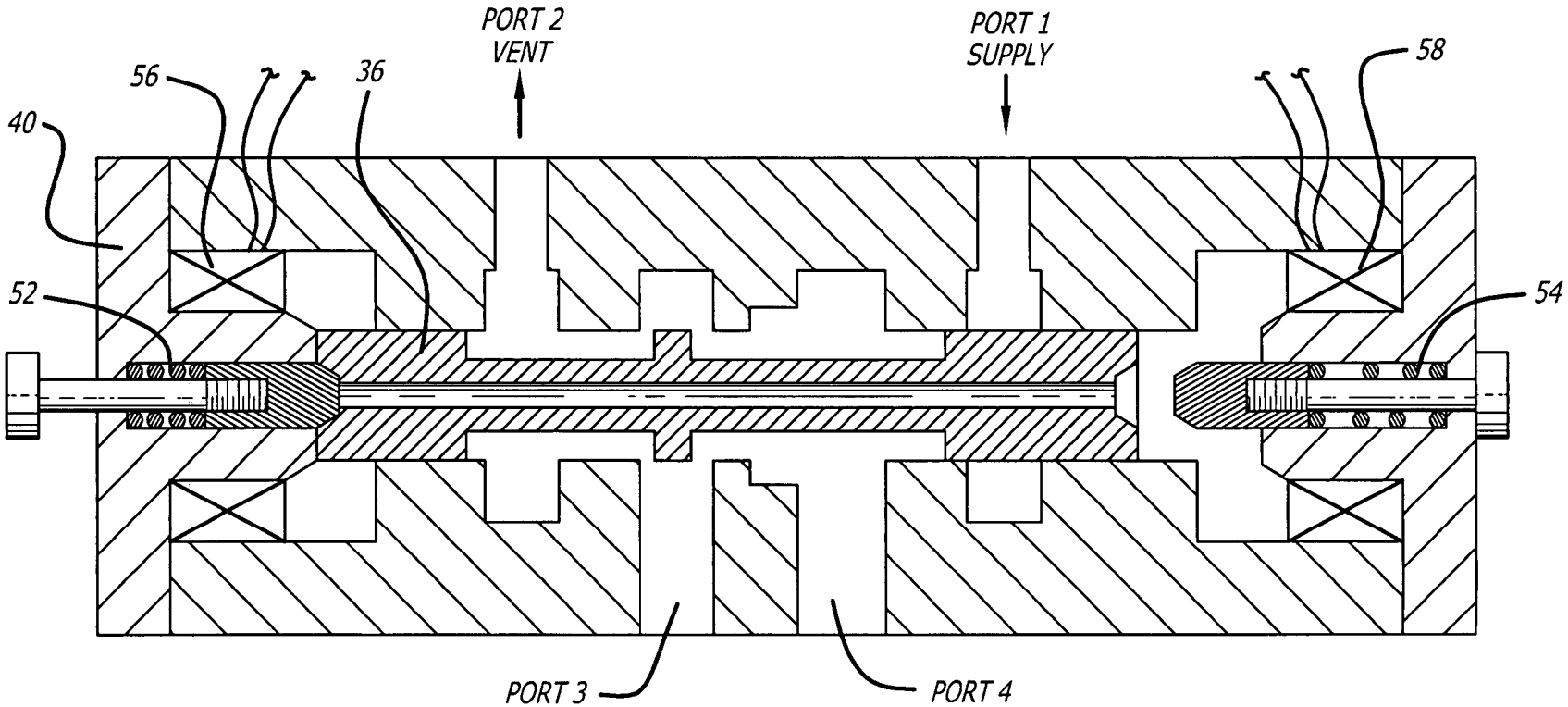
FIG. 2 is an enlarged partial view of FIG. 1 showing the spool of the spool valve in its left-most position.
Figure 3:
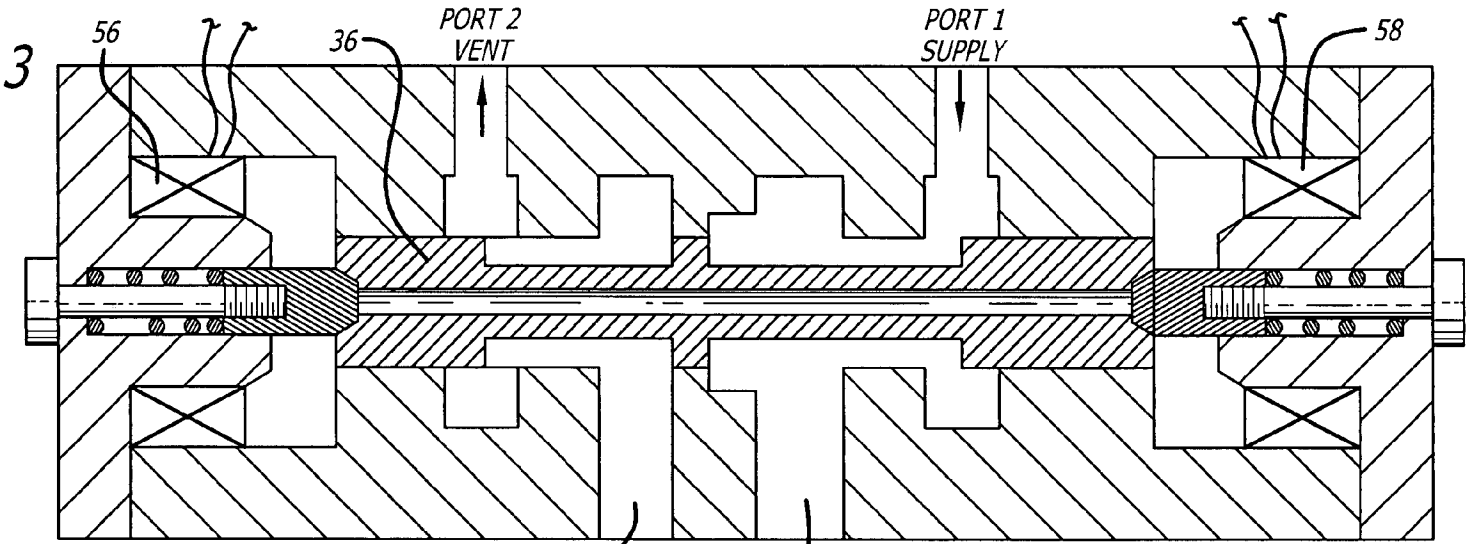
FIG. 3 is a view similar to FIG. 2 but showing the spool of the spool valve in its intermediate position.
Figure 4:
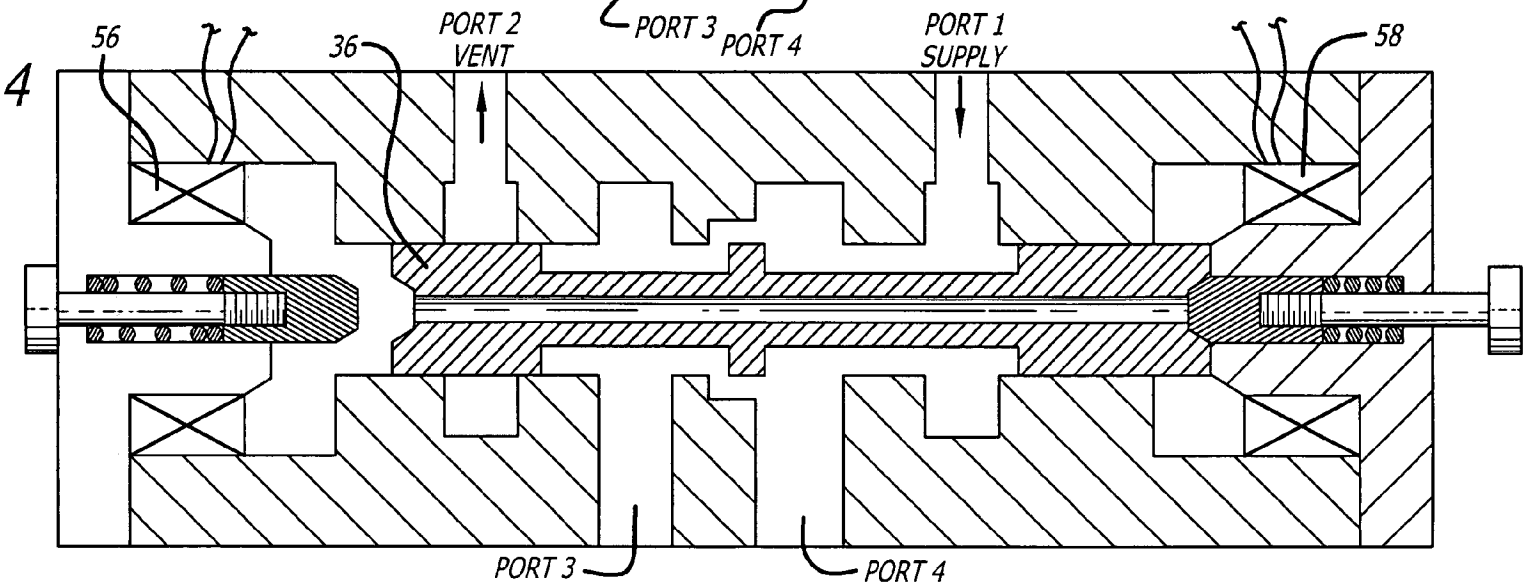
FIG. 4 is a view similar to FIGS. 2 and 3 but showing the spool of the spool valve in its right-most position.

The operation of the three-position spool valve between and during injection events may be explained with respect to FIGS. 2, 3, and 4. Between injection events, the spool 36 will be in its left-most or closed position as shown in FIG. 2, being electromagnetically pulled to that position by excitation of electrical actuator coil 56. In that regard, in the preferred embodiment, use of a spool valve which magnetically latches as a result of the residual magnetism in the magnetic parts of the valve is optional, which allows only a momentary pulse excitation of electrical actuator coil 56 to move the spool 36 to the position shown in FIG. 2 and magnetically latch the same at that position even after electrical current to the coil 56 is terminated. However, it should be understood that this is not a limitation of the present invention, as the spool 36 may be maintained in the position shown by continuous excitation electrical current in electrical actuator coil 56, or alternatively, at least a relatively small holding electrical current.

In any event, when the spool 36 is in the position shown in FIG. 2, port 1 (the actuating fluid supply port) is isolated from the other ports 2, 3 and 4, and ports 3 and 4 communicate with port 2 (the vent port). In this condition, injection fluid (e.g., fuel) is not being injected, though in a typical injector, injection fluid is backfilling the volume below the fluid injection pump piston 26 as spring 34 biases the relatively larger intensifier piston 28 and the relatively smaller intensifier piston 30 upward after a previous injection cycle to their upper most rest position. Also note that while the embodiment disclosed uses a return spring for return of the intensifier pistons 28,30 and the fuel injection pump piston 26 to their initial positions, other return means, such as by way of example, a hydraulic return using fuel, engine oil, hydraulic fluid or some other relatively imcompressible fluid, may be used if desired.

If on the next injection cycle a relatively low rate of injection is desired, the spool 36 is moved to the intermediate position as shown in FIG. 3. In the dual coil magnetically latchable actuator spool control valve, this may be accomplished in a number of ways. By way of example, starting with the spool 36 in the position in FIG. 2, electrical actuator coil 58 may be pulsed to overcome the magnetic force latching or holding the spool 36 in the left-most (closed) position shown in FIG. 2. Once a significant air gap between spool 36 and the adjacent end of end cap 40 is created, the magnetic field that had been latching the spool 36 in the left-most position will collapse. Provided that electrical actuator coil 58 is not pulsed too long, the magnetic field created at the right end portion of the spool 36 (FIG. 2) will also collapse on termination of the electrical current through electrical actuator coil 58. Consequently, the mechanical bias springs 52 and 54 bias and position the spool 36 in the intermediate position shown in FIG. 3 (and FIG. 1). Alternatively, a small predetermined reverse electrical current may be applied to electrical actuator coil 56 to substantially demagnetize the magnetic circuit at that end portion of the spool 36, allowing mechanical bias spring 52 to force the spool 36 away from end cap 40 to again be biased and positioned at the intermediate position by mechanical bias springs 52 and 54.

It should be understood that while the preferred embodiment of the present invention uses a spool and magnetic latching by way of residual magnetism, the present invention multi-stage intensifier method and apparatus may be used with other types of valves, such as poppet valves and the like, as well as valves which do not latch as a result of residual magnetism. By way of example, some valves may require a continuous or holding electrical current, once actuated, to maintain the valve in the actuated position. In such cases, a holding electrical current would be required through electrical actuator coil 56 or its equivalent to maintain the spool 36 or its equivalent in the position shown in FIG. 2. Simply terminating that electrical current would allow mechanical bias springs 52 and 54 to move the spool 36 to the intermediate position. Thus, while the dual actuators spool control valve with latching by way of residual magnetism is optional with the present invention, certainly the present invention is not so limited, and other types of valves, magnetically latching or not, may be used with the present invention.

As stated before, when in the position shown in FIG. 3, port 1 (the supply port) is coupled to port 4 (a cylinder port) providing pressurized actuating fluid (e.g., fuel, engine oil, hydraulic fluid or some other relatively imcompressible fluid) through port 4 to hydraulically actuate and move the relatively smaller intensifier piston 30 (FIG. 1) with the relatively larger intensifier piston 28 being vented through port 3 and vent port 2. Normally the vent pressure will be relatively low, though preferably sufficient to backfill the volume swept out by the downward movement of the relatively larger piston 28 caused by the pressurization of the chamber positioned over the relatively smaller intensifier piston 30. This lower injection rate may be preferred for idle conditions and relatively low load conditions for the engine, as it may reduce noxious emissions by lowering the combustion temperatures and improve engine efficiency in comparison to the injection of the same amount of fuel more concentrated near the top dead center position of the engine piston.

If a high rate of fluid injection is desired, electrical actuator coil 58 may be pulsed to move the spool 36 to the position shown in FIG. 4 and to (optionally) magnetically latch the spool 36 in the position shown. In this position, actuating fluid flow out of vent port 2 is blocked. Port 1, however, is now coupled to both ports 3 and 4, providing actuating fluid supply pressure on both the effective areas of the relatively smaller intensifier piston 30 and the relatively larger intensifier piston 28. This consequently exposes an effective area equal to the full cross sectional area $A_3$ of the relatively larger intensifier piston 28 to actuating fluids pressure, intensifying the pressure of the injection fluid under the injection fluid pumping piston 26 to a pressure equal to $A_3/A_1$ times the actuating fluid supply pressure.

Of course to stop fluid injection, electrical actuator coil 56 (FIG. 2) may be again pulsed in the exemplary embodiment to pull and move the spool 36 to the left-most (closed) position shown in FIG. 2, coupling both ports 3 and 4 to the vent port 2 and blocking the actuating fluid supply port 1.

Figure 5:
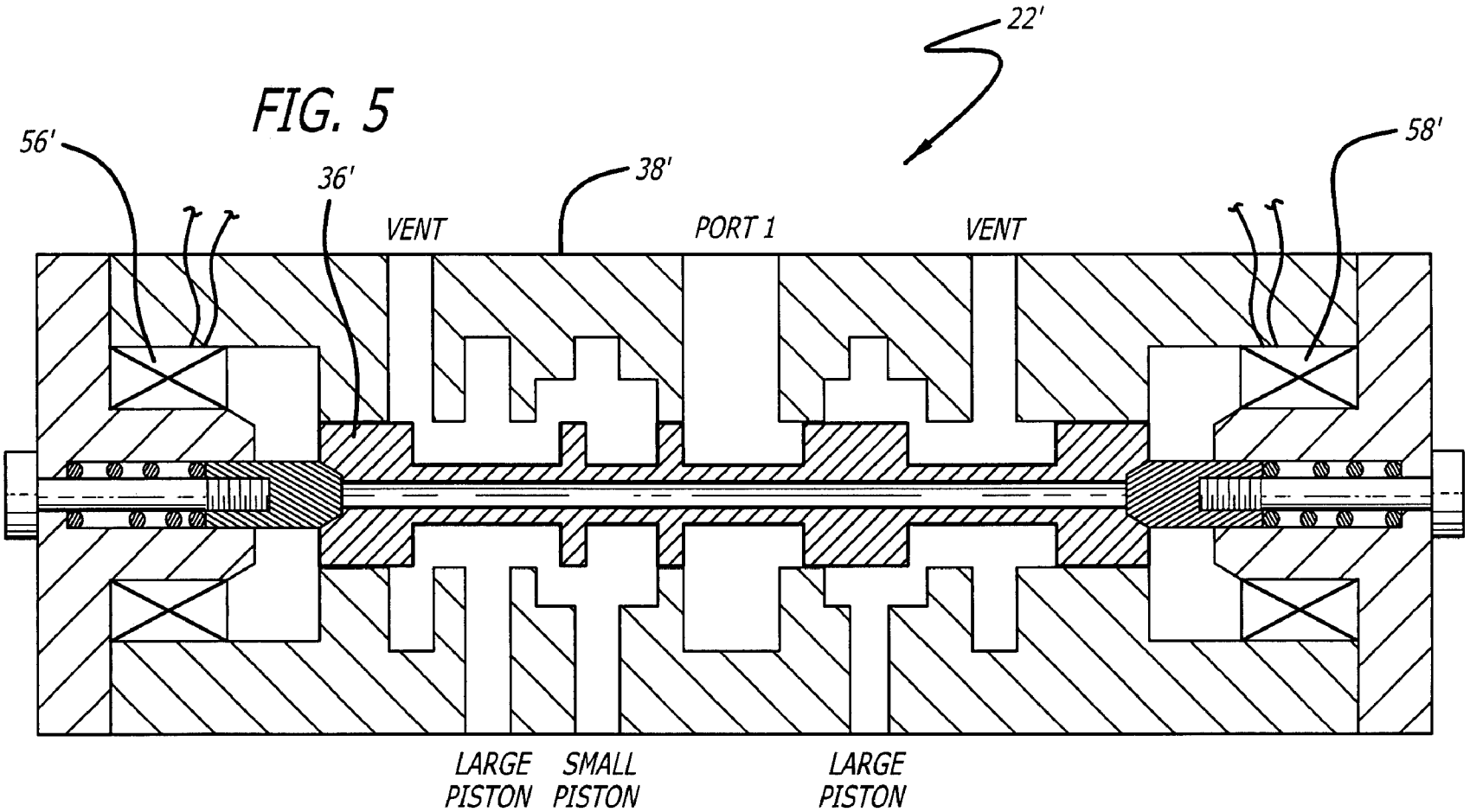
FIG. 5 illustrates an alternative embodiment spool valve with the spool in its intermediate position.
Figure 6:
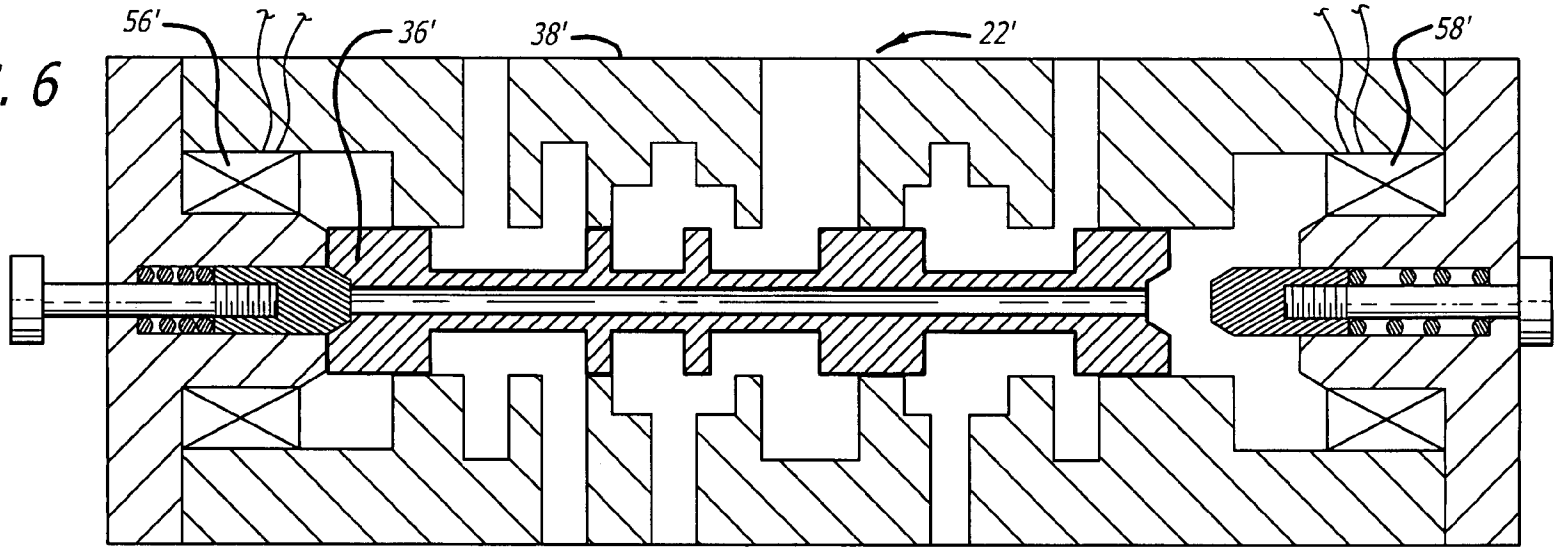
FIG. 6 is a view similar to FIG. 5 but showing the spool of the spool valve in the left-most position.
Figure 7:
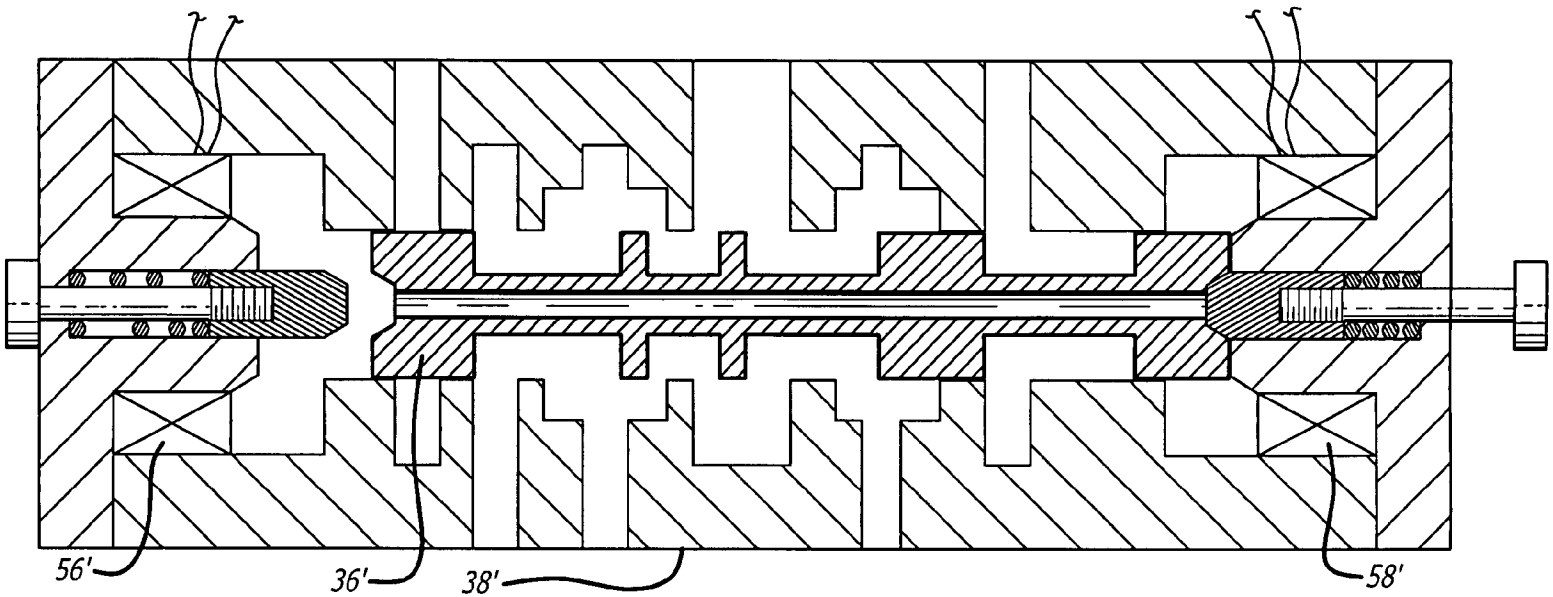
FIG. 7 is a view similar to FIGS. 5 and 6 but showing the spool of the spool valve in the right-most position.

Now referring to FIGS. 5, 6 and 7, an alternate embodiment of the spool valve 22 of FIGS. 1 through 4 may be seen. The spool valve 22' may be identical to the spool valve 22 of the prior Figures except for the lands and porting in the valve housing 38' and the lands on the spool 36'. As a result of the housing and spool differences, with the spool 36' in the intermediate position as shown in FIG. 5, flow from the rail pressure supply port, port 1, is blocked, with ports 3 (coupled to the larger piston) and 4 (coupled to the smaller piston) both being coupled to Port 2, the two vents. Assuming this embodiment also uses two latching actuators, when actuator coil 56' is pulsed to move the spool 36' to the left-most position as shown in FIG. 6, the rail pressure supply port, Port 1, is coupled to port 4, pressurizing the relatively smaller piston 30 (FIG. 1) while Port 3 coupled to the relatively larger piston 28 remains coupled to the vent port, Port 2. On the other hand, when actuator coil 58' is pulsed to move the spool 36' to the right-most position as shown in FIG. 7, the rail pressure supply port, Port 1, is coupled to both ports 3 and 4, pressurizing the smaller piston 30 and the larger piston 28 while flow to the vent, Port 2, is blocked. Therefore, rather than the spool moving between positions determined by electrically energizing the first and second electromagnetic devices for initiating and terminating injection, the spool moves between a first position by electrically energizing one electromagnetic device against the force of a bias means to initiate injection, and a second or intermediate position determined by the bias means to terminate injection. Even if a momentary current in the opposite actuator coil is used to release the spool from its latched condition at the first position, the second or intermediate position is not determined by the excitation of the opposite actuator coil, but rather by the termination of the excitation of the opposite actuator coil, as continued excitation of the opposite actuator coil will cause the spool to latch at the opposite end of the valve housing, initiating injection at another injection pressure. If non-magnetic latching valves were used, injection would be caused by electrically energizing one electromagnetic device and termination of injection would be caused by termination of that excitation. Functionally, the valve 22' of FIGS. 5, 6 and 7 operates like a pair of solenoid actuated, spring return spool valves, not two dual actuator latching (or non-latching) spool valves.

Figure 8:
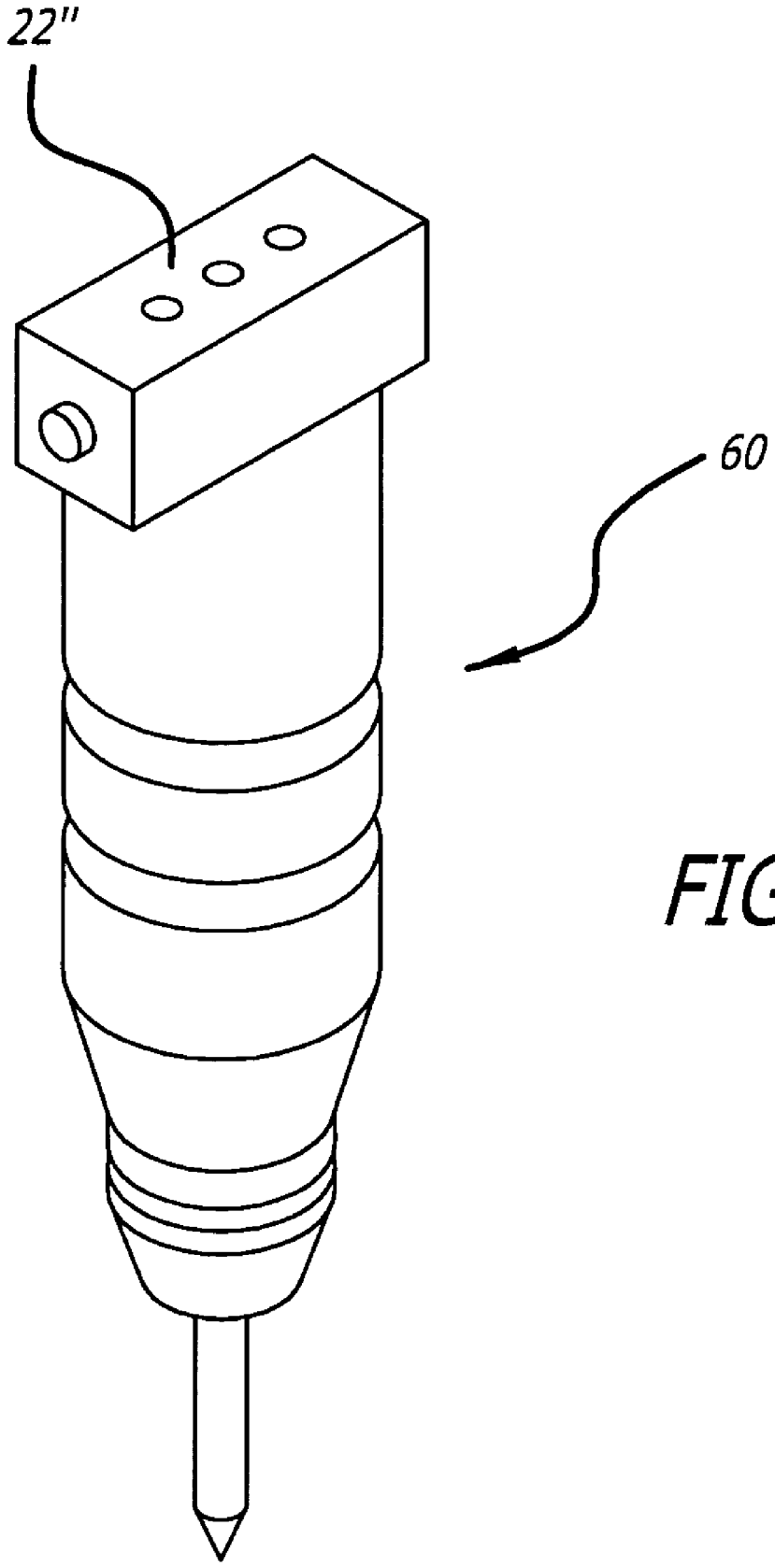
FIG. 8 illustrates a perspective view of the complete injector incorporating the present invention.

FIG. 8 is a perspective view of a complete fluid injector incorporating the present invention. This assembly comprises valve 22" and injector assembly 60. The valve 22" may be in accordance with the valve 22 of FIGS. 1 through 4, or the valve 22' of FIGS. 5 through 7, or of some other design as shall be obvious to one skilled in the art from the disclosure given herein. The injector assembly may be of any prior art intensifier injector design, altered of course to include the multi-stage intensifier, such as hydraulically-actuated electronically controlled injectors disclosed in U.S. Pat. Nos. 5,460,329, 6,085,991 or 6,257,499 B1.

In the foregoing description, it was assumed that on a particular injection event, fluid injection either at a low fluid flow rate or a high fluid flow rate was desired. It is possible however, that a single injection event might be comprised of first movement of the spool 36 from the left-most position shown in FIG. 2 to the intermediate position shown in FIG. 3 to initiate combustion with a low flow rate injection near the top dead center position of the engine piston, and then as the engine piston moves significantly away from the top dead center position, switching the spool 36 to the right-most position shown in FIG. 4 for the higher injection rate before finally terminating all injection. Such a sequence begins to approach a pilot and main injection sequence wherein an initial relatively small fuel injection is used to initiate combustion followed by a relatively larger fuel injection, once combustion is initiated. In that regard, the present invention could be used directly for pilot injection purposes by first moving the spool 36 from the left-most (closed) position shown in FIG. 2 to the intermediate position shown in FIG. 3, and then substantially immediately back to the left-most position shown in FIG. 2, thereby providing a small pilot injection to initiate combustion. This would be followed after a short time by movement of the spool 36 back to the intermediate position of FIG. 3 for continued injection at the relatively low injection rate, or movement of the spool 36 to the right-most position shown in FIG. 4 for injection at the relatively high rate, or alternatively, movement to the intermediate position shown in FIG. 3 for injection at a lower rate for a short period followed by further movement of the spool 36 to the right-most position shown in FIG. 4 for the relatively higher injection rate prior to return of the spool 36 to the left-most position shown in FIG. 2 to terminate injection.

As further alternatives, it should be noted that in the exemplary embodiment described above, actuating fluid supply pressure is applied either to the relatively smaller intensifier piston 30 or both the relatively smaller intensifier piston 30 and the relatively larger intensifier piston 28. Even when applying actuating fluid supply pressure to both of these pistons, the combined effective area is still the area $A_3$ of the relatively larger piston 28. Thus, a valving system could be used for the present invention wherein for the high injection rate, only port 3 is pressurized, as that will effectively pressurize the entire top area of the relatively larger intensifier piston 28. In such an arrangement, the relatively smaller intensifier piston 30 would need to be vented and its initial position should be against a stop, preventing further upward movement of the relatively smaller piston 30, or alternatively, with the spool 36 blocking port 4 so that the relatively smaller piston 30 is hydraulically locked in position as opposed to mechanically locked in position. Further, if the relatively smaller intensifier piston 30 is mechanically locked to the relatively larger intensifier piston 28, then applying the actuating fluid supply pressure to the relatively larger intensifier piston, will provide a hydraulic force on the injection fluid pumping piston 26 equal to the actuating fluid supply pressure times the difference in effective areas between the relatively larger intensifier piston 28 and the relatively smaller intensifier piston 30. Under these conditions, preferably the effective area over the relatively smaller intensifier piston 30 should be vented to prevent cavitation.

Figure 9:
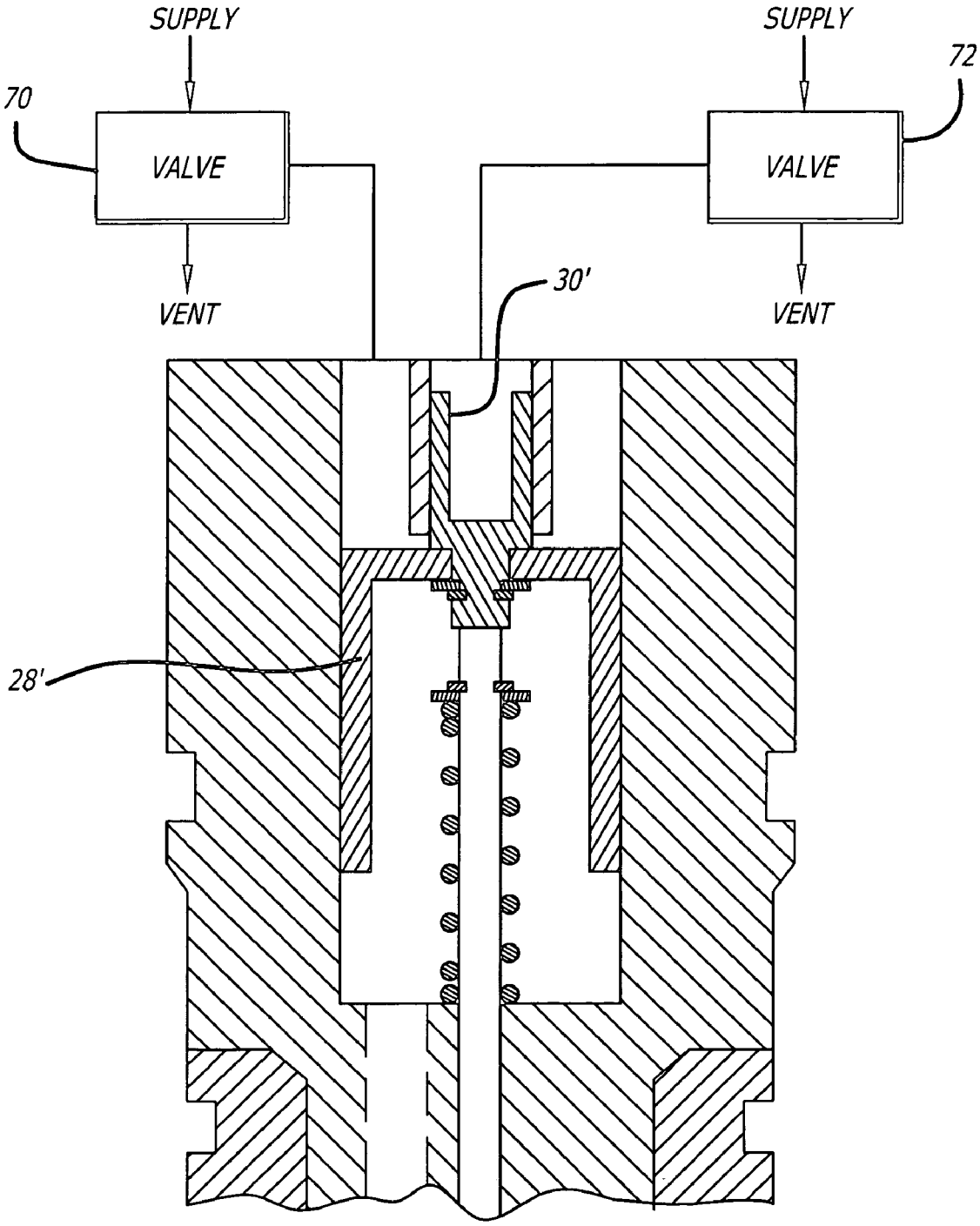
FIG. 9 illustrates an alternative embodiment similar to FIG. 1, but with the smaller intensifier piston 30' mechanically coupled to the larger intensifier piston 28', and controlled by a pair of two-position, three-way valves.

The present invention has been disclosed and described herein with respect to the use of a two-stage intensifier using a relatively smaller intensifier piston 30 and a relatively larger intensifier piston 28. Obviously using the concepts of the present invention, one or more additional pistons or effective piston areas might also be used, such as, by way of example, three pistons to provide three distinctive hydraulic effective areas for selective pressurization by actuating fluid pressure. However, even using the two-piston arrangement illustrated by the present disclosure, various other possibilities also exist. By way of example, the dual intensifier piston arrangement disclosed herein could also be controlled by two two-position, three-way valves. One valve would be used to control the coupling to the effective area $A_2$ over the relatively smaller piston 30, either to the actuating fluid supply pressure or to the vent pressure, and the other valve being used to couple the effective area $A_3$ over the relatively larger piston 28 to either the actuating fluid supply pressure or the vent. Further, it should be noted that if the relatively smaller intensifier piston 30' is mechanically coupled to the relatively larger intensifier piston 28' so as to necessarily move vertically in unison therewith as shown in FIG. 9, the two two-position, three-way valves 70 and 72, or equivalent, provide an additional degree of versatility. Specifically, providing actuating fluid supply pressure over the relatively smaller intensifier piston 30' and venting the relatively larger intensifier piston 28' would provide a relatively low injection rate, providing actuating fluid supply pressure over the relatively larger piston 28' and venting the relatively smaller piston 30' could provide a relatively higher injection rate, and providing actuating fluid supply pressure to both the relatively smaller intensifier piston 30' and the relatively larger intensifier piston 28' would provide the relatively highest injection rate.

While perhaps mechanically complex, consider the possibility of a three-stage intensifier controlled by three two-position three-way valves by proper selection of the hydraulic areas $A_1$, $A_2$, and $A_3$ of the pistons, one would have seven possible fluid injection flow rates, namely i) the pressurizing $A_1$, ii) the pressurizing $A_2$, iii) the pressurizing $A_3$, iv) the pressurizing $A_1$ and $A_2$, v) the pressurizing $A_1$ and $A_3$, vi) the pressurizing $A_2$ and $A_3$, and vii) the pressurizing $A_1$, $A_2$, and $A_3$. As a further example, assumed $A_2$ is twice the area of $A_1$, and $A_3$ is twice the area of $A_2$, then the relative injection pressures available are 1×, 2×, 3×, 4×, 5×, 6×, and 7×. Note that in such a configuration, the hydraulic effective areas are not the hydraulic cylinder areas themselves. In particular, assume that the piston cross sectional areas are $A_A$, $A_B$, and $A_C$, where $A_A<A_B<A_C$. In such case, $A_1=A_A$, $A_2=A_B-A_A$ and $A_3=A_C-A_B$.

There has been described herein certain specific embodiments of the present invention to illustrate some of the multitude of ways the invention may be implemented and practiced. The disclosed embodiments are exemplary only, as the present invention may be practiced in ways too numerous to each be individually disclosed herein. Thus, while certain preferred embodiments of the present invention have been disclosed, it will be obvious to those skilled in the art that various changes in form and detail may be made therein without departing from the spirit and scope of the invention.

What is claimed is:

1. A multi-stage intensifier adapted for a fluid injector comprising:

a fluid injection pump piston adapted to pressurize injection fluid when moved in a first direction;

a first intensifier piston positioned to apply force to the fluid injection pump piston in the first direction responsive to the pressure of an actuating fluid against an effective area of the first intensifier piston;

a second intensifier piston positioned to apply force to the fluid injection pump piston in the first direction responsive to the pressure of an actuating fluid against an effective area of the second intensifier piston; and, a control valve coupled to selectively apply actuating fluid pressure to any of:

i) the effective area of the first intensifier piston, ii) the effective area of the second intensifier piston, and iii) the effective area of both the first and second intensifier pistons.

2. The multi-stage intensifier of claim 1, wherein the control valve comprises two, two-position, three-way valves.

3. The multi-stage intensifier of claim 1, wherein the first and second intensifier pistons are coupled together.

4. The multi-stage intensifier of claim 3, wherein the control valve comprises two, two-position, three-way valves.

5. The multi-stage intensifier of claim 4, wherein the three-way valves are magnetically latchable spool valves using residual magnetism.

6. The multi-stage intensifier of claim 1, wherein the actuating fluid is selected from the group consisting of fuel, engine oil and hydraulic fluid and the injection fluid is fuel.

7. A fluid injector having a multistage intensifier comprising:

an injector adapted to inject fluid responsive to the pressurization of an injection fluid;

a fluid injection pump piston adapted to pressurize injection fluid when moved in a first direction;

a first intensifier piston positioned to apply force to the fluid injection pump piston in the first direction responsive to the pressure of an actuating fluid against an effective area of the first intensifier piston;

a second intensifier piston positioned to apply force to the fluid injection pump piston in the first direction responsive to the pressure of an actuating fluid against an effective area of the second intensifier piston; and, a control valve coupled to selectively apply actuating fluid pressure to any of:

i) the effective area of the first intensifier piston, ii) the effective area of the second intensifier piston, and iii) the effective area of both the first and second intensifier pistons.

8. A method of operating a fuel injector having a multi-stage intensifier, comprising:

providing a fuel injection pumping piston adapted to pressurize injection fuel when hydraulically moved in a first direction;

providing a first effective area of the multi-stage intensifier responsive to an actuating fluid pressure to move the injection fuel pumping piston in the first direction;

providing a second effective area of the multi-stage intensifier responsive to an actuating fluid pressure to move the injection fuel pumping piston in the first direction, the first and second effective areas being unequal areas;

selectively providing actuating fluid under pressure to the first effective area or the second effective area or simultaneously providing actuating fluid under pressure to the first and second effective areas to selectively pressurize injection fuel by the injection fuel pumping piston.

9. The method of claim 8, wherein selectively providing actuating fluid under pressure to the first effective area, the second effective area, and both the first and second effective areas comprises providing actuating fluid under pressure using two, two-position, three-way valves.

10. The method of claim 8, wherein the actuating fluid is selected from the group consisting of fuel, engine oil and hydraulic fluid.

* * * * *